US007438520B2

(12) United States Patent
Ruthemeyer et al.

(10) Patent No.: US 7,438,520 B2
(45) Date of Patent: Oct. 21, 2008

(54) THERMALLY COMPLIANT TURBINE SHROUD MOUNTING ASSEMBLY

(75) Inventors: Michael Anthony Ruthemeyer, Cincinnati, OH (US); Glenn Herbert Nichols, Mason, OH (US); Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 517 days.

(21) Appl. No.: 11/161,516

(22) Filed: Aug. 6, 2005

(65) Prior Publication Data

US 2007/0031243 A1 Feb. 8, 2007

(51) Int. Cl.
*F01D 11/08* (2006.01)

(52) U.S. Cl. ..... 415/135; 415/173.1

(58) Field of Classification Search ..... 415/134, 415/135, 136, 137, 173.1, 173.3, 174.2, 213.1; 277/647

See application file for complete search history.

(56) References Cited

U.S. PATENT DOCUMENTS 3,860,358 A * 1/1975 Cavicchi et al. ..... 415/173.1
6,354,795 B1 3/2002 White et al.
6,361,273 B1 * 3/2002 Eng et al. ..... 415/173.1
2002/0048512 A1 * 4/2002 Cot et al. ..... 415/173.1

* cited by examiner

*Primary Examiner*—Richard Edgar
(74) *Attorney, Agent, or Firm*—Adams Intellectual Property Law, PA.; William Scott Andes, Esq.

(57) ABSTRACT

A shroud assembly is provided for a gas turbine engine that has a temperature at a hot operating condition substantially greater than at a cold assembly condition thereof. The shroud assembly includes: at least one arcuate shroud segment adapted to surround a row of rotating turbine blades which has an arcuate, axially extending mounting flange; a shroud hanger having an arcuate, axially-extending hook disposed in mating relationship to the mounting flange; and an arcuate C-clip having inner and outer arms overlapping the hook and the mounting flange. The curvatures of the mounting flange and the inner arm of the C-clip are selected so as to define a matched interface therebetween. Their curvatures are substantially greater that the curvature of the hook.

14 Claims, 10 Drawing Sheets

THERMALLY COMPLIANT TURBINE SHROUD MOUNTING ASSEMBLY

BACKGROUND OF THE INVENTION

This invention relates generally to gas turbine components, and more particularly to turbine shrouds and related hardware.

It is desirable to operate a gas turbine engine at high temperatures for efficiently generating and extracting energy from these gases. Certain components of a gas turbine engine, for example stationary shroud segments and their supporting structures, are exposed to the heated stream of combustion gases. The shroud is constructed to withstand primary gas flow temperatures, but its supporting structures are not and must be protected therefrom. To do so, a positive pressure difference is maintained between the secondary flowpath and the primary flowpath. This is expressed as a back flow margin or "BFM". A positive BFM ensures that any leakage flow will move from the non-flowpath area to the flowpath and not in the other direction.

In prior art turbine designs, various arcuate features such as the above-mentioned shrouds, retainers (referred to as "C-clips"), and supporting members are designed to have matching circumferential curvatures at their interfaces under cold (i.e. room temperature) assembly conditions. During hot engine operation condition, the shrouds and hangers heat up and expand according to their own temperature responses. Because the shroud temperature is much hotter than the hanger temperature and the shroud segment is sometimes smaller than the hanger segment or ring, the curvature of the shroud segment will expand more and differently from the hanger curvature at the interface under steady state, hot temperature operation conditions. When the engine is at operating conditions, the C-clip (which is applied at room temperature during assembly, usually with a pre-loaded interference fit) expands to allow thermal deformation in the mating hardware. Stress is induced in the C-clip and mating hardware as the thermal deformation increases. The larger the thermal gradients the larger the stress and the higher the risk of part failure and cracking, lowering the operational life of the C-clip. The thermal deformation can also result in gaps in the shroud assembly which increases undesired leakage, reducing BFM.

Accordingly, there is a need for an assembly that can reduce the curvature deviation effects on the C-clip at the hot operation condition, minimizing the adverse impact to the C-clip, shroud, and hanger durability.

BRIEF SUMMARY OF THE INVENTION

The above-mentioned need is met by the present invention, which according to one aspect provides a shroud assembly for a gas turbine engine having a temperature at a hot operating condition substantially greater than at a cold assembly condition thereof. The shroud assembly includes: at least one arcuate shroud segment adapted to surround a row of rotating turbine blades, the shroud segment having an arcuate, axially extending mounting flange; a shroud hanger having an arcuate, axially-extending hook disposed in mating relationship to the mounting flange; and an arcuate C-clip having inner and outer arms overlapping the hook and the mounting flange. The curvatures of the mounting flange and the inner arm of the C-clip are selected so as to define a matched interface therebetween, the curvatures being substantially greater than a curvature of the hook.

According to another aspect of the invention, a shroud assembly for a gas turbine engine includes: a shroud hanger having an arcuate, axially-extending hook having a first cold curvature at an ambient temperature, and a first hot curvature at an operating temperature substantially greater than the ambient temperature; at least one arcuate shroud segment adapted to surround a row of rotating turbine blades, the shroud segment having an arcuate, axially extending mounting flange having a second cold curvature at the ambient temperature, and a second hot curvature at the operating temperature, the mounting flange disposed in mating relationship to the hook; and an arcuate C-clip having inner and outer arms overlapping the hook and the mounting flange, the inner arm of the C-clip having a third cold curvature at the ambient temperature and a third hot curvature at the operating temperature. The second and third cold curvatures are selected such that the first and second hot curvatures define a matched interface therebetween.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
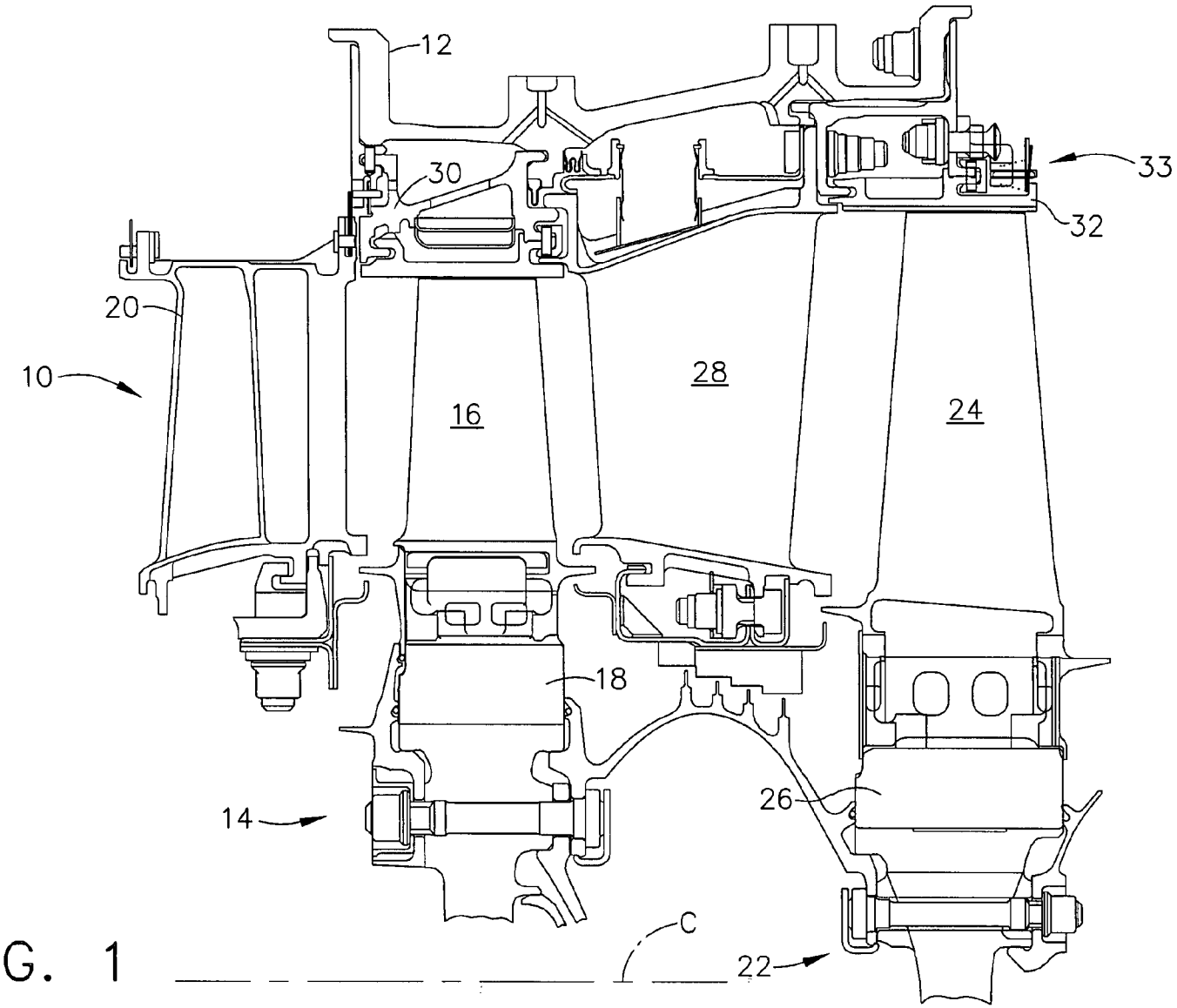
FIG. 1 is a cross-sectional view of an exemplary high-pressure turbine section incorporating the shroud assembly of the present invention.

Referring to the drawings wherein identical reference numerals denote the same elements throughout the various views, FIG. 1 illustrates a portion of a high-pressure turbine (HPT) 10 of a gas turbine engine. The HPT 10 includes a number of turbine stages disposed within an engine casing 12. As shown in FIG. 1, the HPT 10 has two stages, although different numbers of stages are possible. The first turbine stage includes a first stage rotor 14 with a plurality of circumferentially spaced-apart first stage blades 16 extending radially outwardly from a first stage disk 18 that rotates about the centerline axis "C" of the engine, and a stationary first stage turbine nozzle 20 for channeling combustion gases into the first stage rotor 14. The second turbine stage includes a second stage rotor 22 with a plurality of circumferentially spaced-apart second stage blades 24 extending radially outwardly from a second stage disk 26 that rotates about the centerline axis of the engine, and a stationary second stage nozzle 28 for channeling combustion gases into the second stage rotor 22. A plurality of arcuate first stage shroud segments 30 are arranged circumferentially in an annular array so as to closely surround the first stage blades 16 and thereby define the outer radial flowpath boundary for the hot combustion gases flowing through the first stage rotor 14.

A plurality of arcuate second stage shroud segments 32 are arranged circumferentially in an annular array so as to closely surround the second stage blades 24 and thereby define the outer radial flowpath boundary for the hot combustion gases flowing through the second stage rotor 22. The shroud segments 32 and their supporting hardware are referred to herein as a "shroud assembly" 33. While the present invention is described with respect to the second stage of the HPT, the principle is equally applicable to other portions of the turbine.

Figure 2:
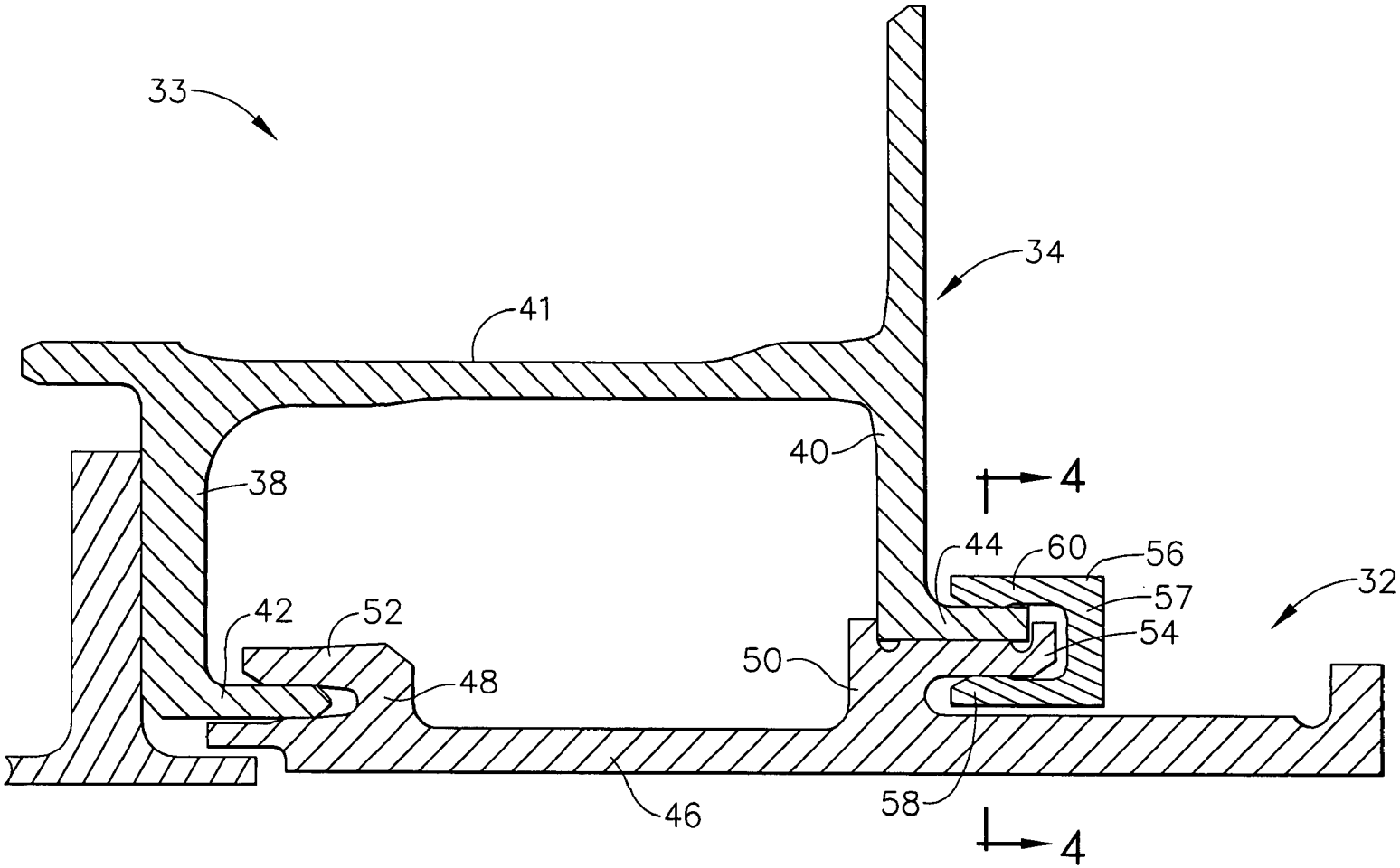
FIG. 2 is an enlarged view of a portion of the turbine section of FIG. 1.

FIG. 2 illustrates the prior art shroud assembly 33 in more detail. A supporting structure referred to as a "shroud hanger" 34 is mounted to the engine casing 12 (see FIG. 1) and retains the second stage shroud segment 32 to the casing 12. The shroud hanger 34 is generally arcuate and has spaced-apart forward and aft radially-extending arms 38 and 40, respectively, connected by a longitudinal member 41. The shroud hanger 34 may be a single continuous 360° component, or it may be segmented into two or more arcuate segments. An arcuate forward hook 42 extends axially aft from the forward arm 38, and an arcuate aft hook 44 extends axially aft from the aft arm 40.

Each shroud segment 32 includes an arcuate base 46 having radially outwardly extending forward and aft rails 48 and 50, respectively. A forward mounting flange 52 extends forwardly from the forward rail 48 of each shroud segment 32, and an aft mounting flange 54 extends rearwardly from the aft rail 50 of each shroud segment 32. The shroud segment 32 may be formed as a one-piece casting of a suitable superalloy, such as a nickel-based superalloy, which has acceptable strength at the elevated temperatures of operation in a gas turbine engine. The forward mounting flange 52 engages the forward hook 42 of the shroud hanger 34. The aft mounting flange 54 of each shroud segment 32 is juxtaposed with the aft hook 44 of the shroud hanger 34 and is held in place by a plurality of retaining members commonly referred to as "C-clips" 56.

The C-clips 56 are arcuate members each having a C-shaped cross section with inner and outer arms 58 and 60, respectively, that snugly overlap the aft mounting flanges 54 and the aft hooks 44 so as to clamp the aft ends of the shroud segments 32 in place against the shroud hangers 34. The inner and outer arms are joined by an arcuate, radially-extending flange 57. Although they could be formed as a single continuous ring, the C-clips 56 are typically segmented to accommodate thermal expansion. Typically, one C-clip 56 clamps at least one shroud segment.

Figure 3:
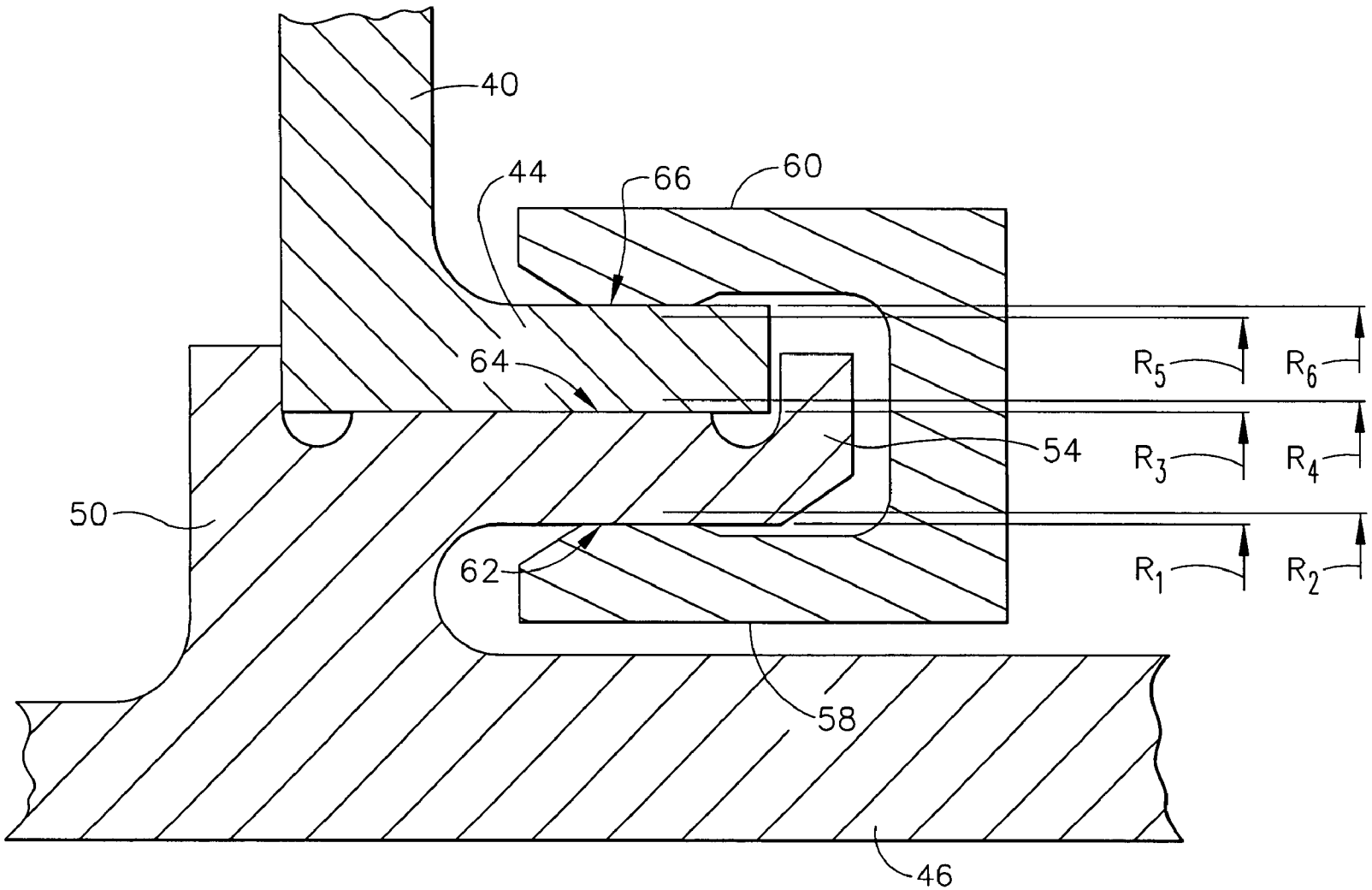
FIG. 3 is an enlarged cross-sectional view of a portion of FIG. 2.

FIG. 3 is an enlarged view of the aft portion of the shroud segment 32, showing the radii of various components. "R1" is the outside radius of the inner arm 58 of the C-clip 56. "R2" is the inside radius of the aft mounting flange 54 of the shroud segment 32, and "R3" is its outside radius. "R4" is the inside radius of the aft hook 44 of the shroud hanger 34, and "R5" is its outside radius. Finally, "R6" is the inside radius of the outer arm 60 of the C-clip 56. These radii define interfaces 62, 64, and 66 between the various components. For example, the radii "R1" of the lower C-clip arm 58 and "R2" of the aft mounting flange 54 meet at the interface 62.

Figure 4A:
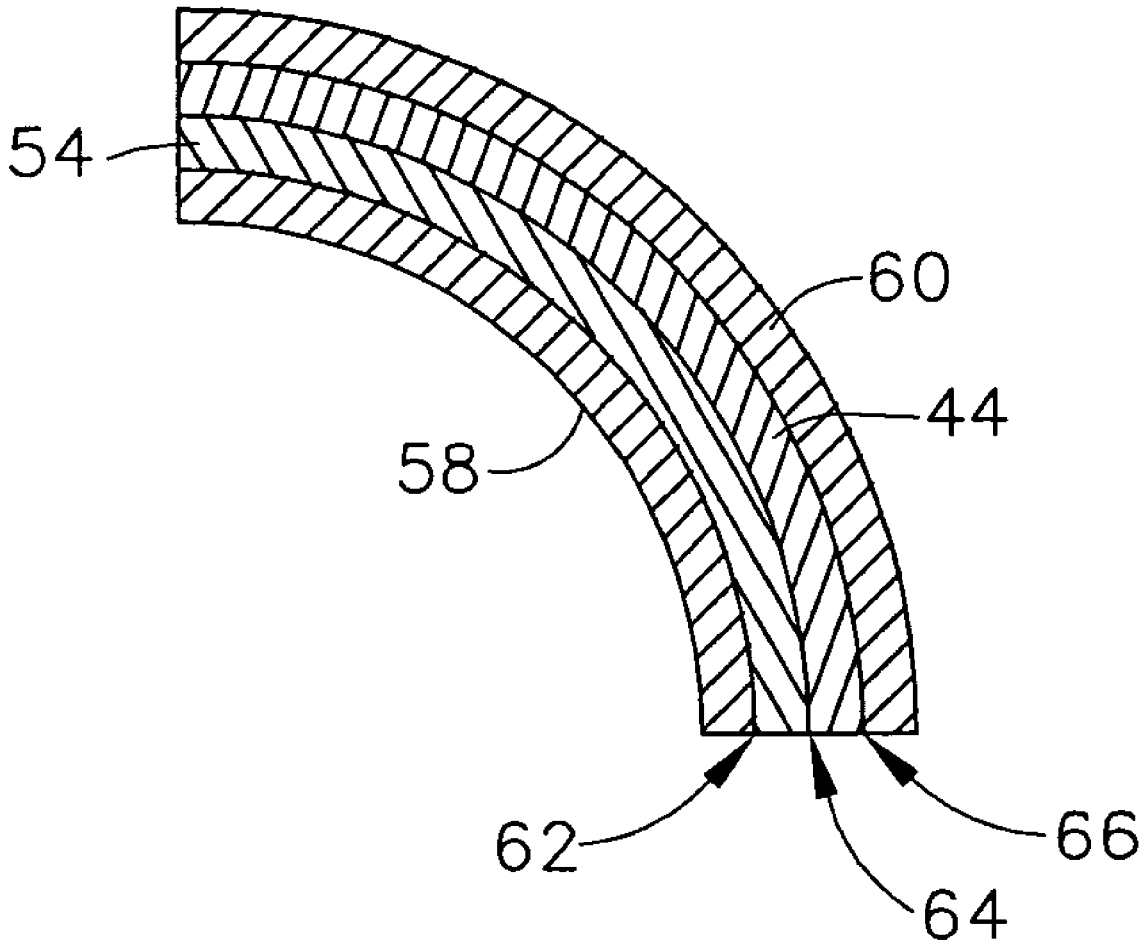
FIG. 4A (PRIOR ART)
FIG. 4A is partial cross-sectional view taken along lines 4-4 of FIG. 2 at a cold assembly condition.

FIG. 4A shows the circumferential relationship of the curvatures of these interfaces 62, 64, and 66 at a cold (i.e. room temperature) assembly condition. The curvatures are designed to result in a preselected dimensional relationship at this condition. The term "preselected dimensional relationship" as used herein means that a particular intended relationship between components applies more or less consistently at the interface, whether that relationship be a specified radial gap, a "matched interface" where the gap between components is nominally zero, or a specified amount of radial interference. For example, in FIG. 4A, there is a preselected amount of radial interference at each point around the circumference of the interfaces 62 and 66, in order to provide a predetermined clamping force to the aft mounting flange 54 and the aft hook 44, in accordance with known engineering principles. The interface 64 is a "matched interface" in that radius R3 is equal to radius R4. It should be noted that the term "curvature" is used to refer to deviation from a straight line, and that the magnitude of curvature is inversely proportional to the circular radius of a component or feature thereof.

Figure 4B:
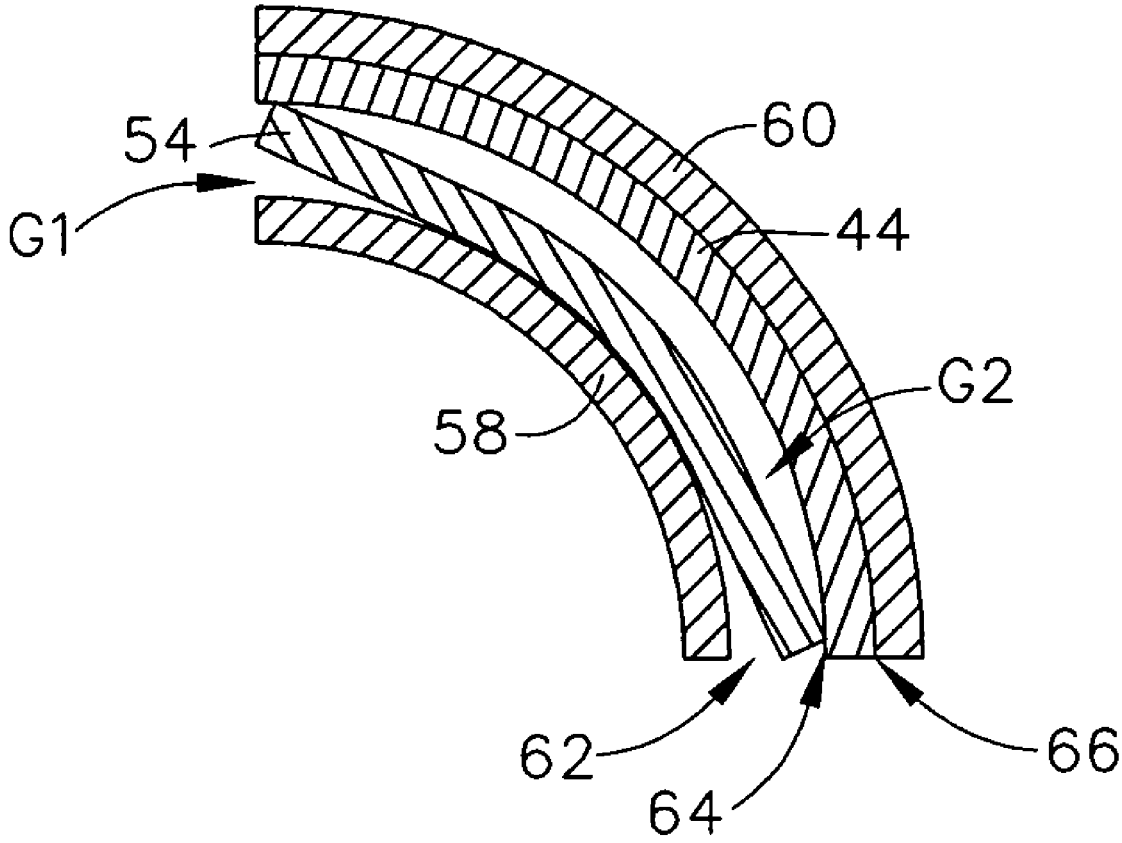
FIG. 4B (PRIOR ART)
FIG. 4B is partial cross-sectional view taken along lines 4-4 of FIG. 2 at a hot operating condition.

FIG. 4B illustrates the changes of the interfaces 62, 64, and 66 from a cold assembly condition to a hot engine operation condition. At operating temperatures, for example bulk material temperatures of about 538° C. (1000° F.) to about 982° C. (1800° F.), all of the shroud segment 32, shroud hanger 34, and C-clip 56 will heat up and expand according to their own temperature responses. Because the shroud temperature is much hotter than the hanger temperature, the curvature of the shroud segment 32 will expand more and differently from the hanger curvature at the interface 64 under steady state, hot temperature operation conditions. In addition, there is more thermal gradient within the shroud segment 32 than in the shroud hanger 34.

As a result, the shroud segment 32 and its aft mounting flange 54 will tend to expand and increase its radius into a flattened shape (a phenomenon referred to as "cording") to a much greater degree than either the C-clip 56 or the aft hook 44. This causes gaps "G1" and "G2" to be formed at the interfaces 62 and 64 respectively. The gap G1 forces the C-clip 56 open and induces stress in the assembly. These stresses limit part life and increase risk of failure. The gap G2 can allow undesired leakage past the shroud segment.

Figure 5:
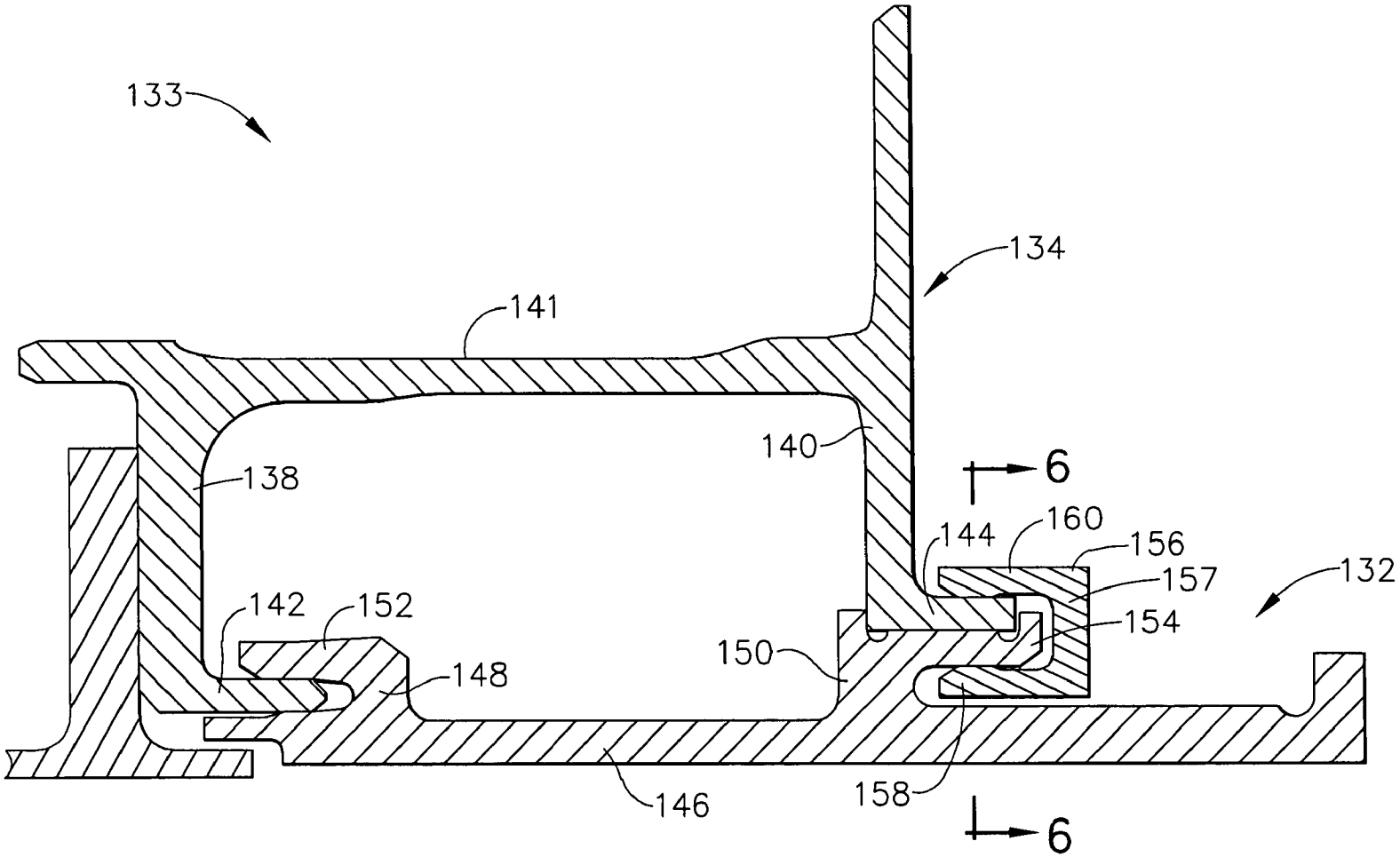
FIG. 5 is a cross-sectional view of a shroud assembly constructed according to the present invention.

FIG. 5 illustrates a shroud assembly 133 constructed according to the present invention. The shroud assembly 133 is substantially identical in most aspects to the prior art shroud assembly 33 and includes a "shroud hanger" 134 with spaced-apart forward and aft radially-extending arms 138 and 140, respectively, connected by a longitudinal member 141, and arcuate forward and aft hooks 142 and 144. A shroud segment 132 includes an arcuate base 146 with forward and aft rails 148 and 150, carrying forward and aft mounting flanges 152 and 154, respectively. The forward mounting flange 152 engages the forward hook 142 of the shroud hanger 134. The aft mounting flange 154 engages the aft hook 144. The shroud segment 132 is held in place by a plurality of "C-clips" 156 each having inner and outer arms 158 and 160, respectively, joined together by a flange 157.

Figure 6A:
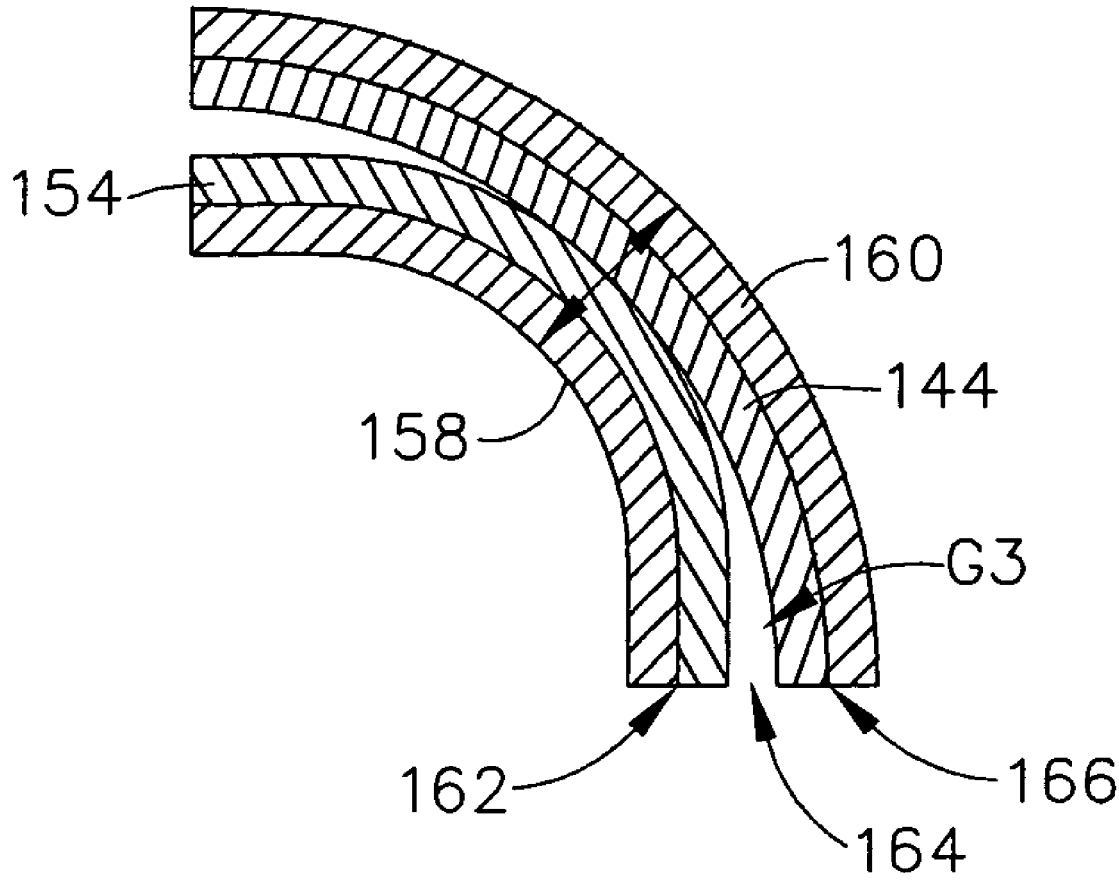
FIG. 6A is partial cross-sectional view taken along lines 6-6 of FIG. 5 at a cold assembly condition.

The shroud assembly 133 differs from the shroud assembly 33 primarily in the selection of certain dimensions of the shroud segment 132 and the C-clips 156 which affect the interfaces 162 and 164. FIG. 6A shows the relationship of the curvatures of these interfaces at a cold (i.e. ambient environmental temperature) assembly condition, also referred to as their "cold curvatures". The "hot" curvatures of the interfaces are selected to achieve a preselected dimensional relationship at the anticipated hot engine operating condition, meaning that they are intentionally "mismatched" or "corrected" at the cold assembly condition based on each component's thermal growth differences. Specifically, the curvature of the inner arm 158 of the C-clip 156 and the aft mounting flange 154 are made substantially greater than that of the inner surface of the shroud aft hook 144, producing a gap "G3" in the interface 164 at the cold condition. The interface 162 includes a preselected amount of radial interference to produce a clamping load on the aft mounting flange 154 and the aft hook 144.

Figure 6B:
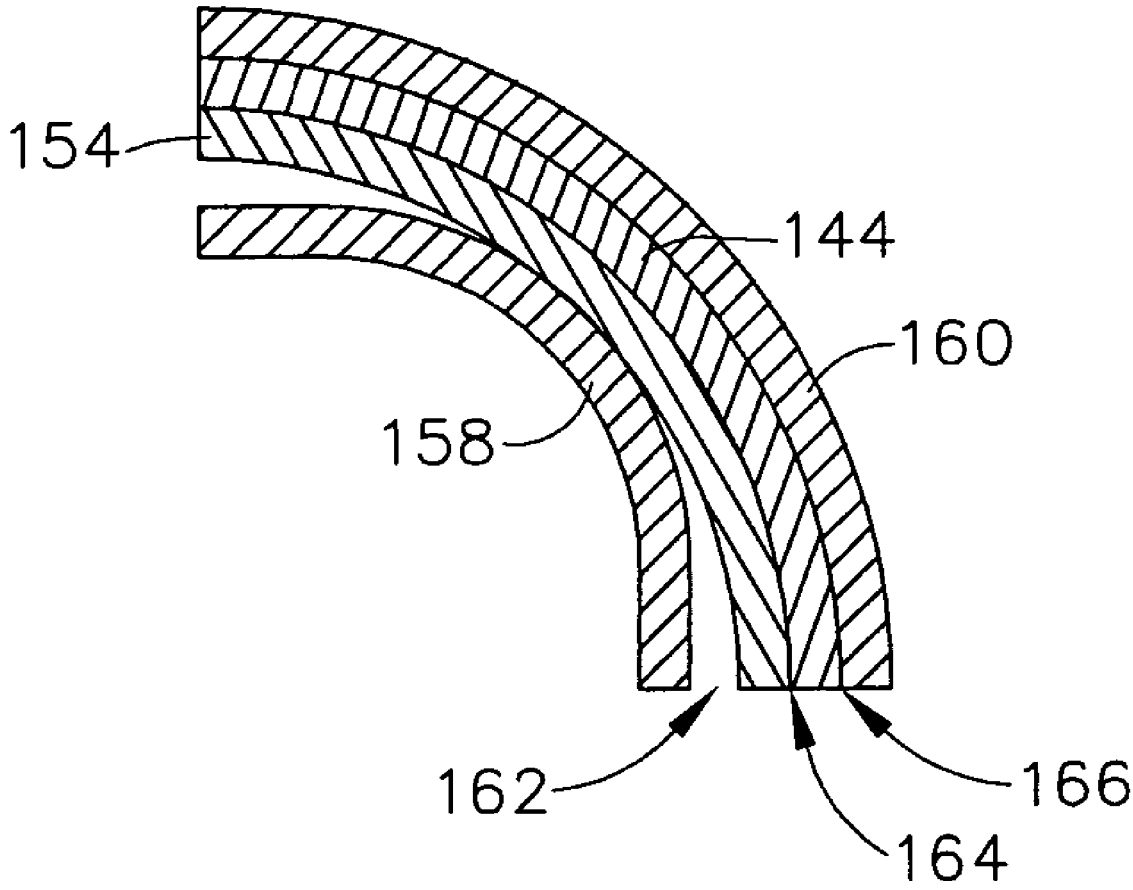
FIG. 6B is partial cross-sectional view taken along lines 6-6 of FIG. 5 at a hot operating condition.

At operating temperatures, for example bulk material temperatures of about 538° C. (1000° F.) to about 982° C. (1800° F.), the shroud segment 132 and its aft mounting flange 154 will be hotter and expand more than the shroud hanger aft hook 144 or the inner and outer arms 158 and 160 of the C-clip 156, as shown in FIG. 6B. The provision of the gap "G3" at the cold assembly condition allows the aft mounting flange 154 to flatten out as it heats up without putting undue stress on the inner arm 158 of the C-clip 156, and to form a better seal with the aft hook 144 to lower the leakage flow at the hot operating condition. Since the interface 164 is matched, the risk of inducing bending stress at operating conditions is also reduced or eliminated.

Using this configuration, the C-clip 156 maintains contact with the aft mounting flange 154 at both hot and cold temperatures. A degree of radial interference and thus clamping load is maintained at hot operating temperature. It provides the added benefit of limiting leakage at colder cycle conditions such as ground idle by sealing the interface 162. It also avoids cold assembly bending stress because the radius of curvature of the C-clip inner arm 158 is equal to or smaller than the radius of curvature of the shroud aft mounting flange 154 at the cold condition, as illustrated in FIG. 6A.

To calculate the desired correction, a suitable means of modeling the high-temperature behavior of the shroud assembly 133 is used to simulate the dimensional changes in the components as they heat to the hot operating condition. The cold dimensions of the components are then set so that the appropriate "stack-up" or dimensional interrelationships will be obtained at the hot operating condition.

The amount of correction will vary with the particular application. To completely eliminate the effects of thermal expansion, a change on the order of 2 or 3 inches in the radius of the selected component might be required. This would theoretically allow the interface 164 to match at the hot operating condition. This result is what is depicted in FIG. 6B.

Figure 7A:
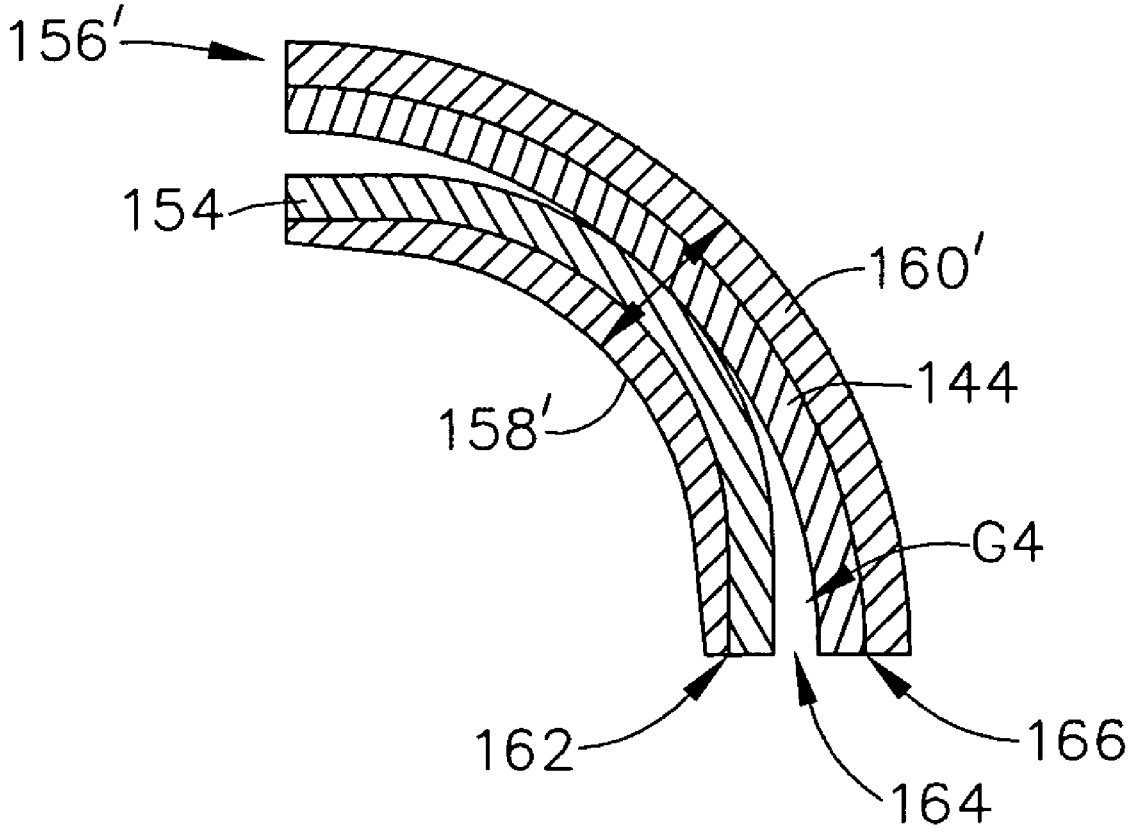
FIG. 7A is partial cross-sectional view taken along lines 6-6 of FIG. 5 at a cold assembly condition, showing an alternative shroud assembly.

In actual practice, a balance must be struck between obtaining the preselected dimensional relationship to the desired degree at the hot operating condition, and basic compatibility of the various components in the shroud assembly 133. The component stresses must also be kept within acceptable limits at the cold assembly condition. In the illustrated example, the outside radius of the aft mounting flange 154 is about 0.76 mm (0.030 in.) to about 1.3 mm (0.050 in.) less than the corresponding dimension of the prior art aft mounting flange 54, and the curvature of the inner arm 158 of the C-clip 156 is modified by a like amount It is also possible to achieve a desired dimensional relationship by varying the thickness of one or more of the components to thereby modify their effective curvature. For example, FIG. 7A illustrates an assembly using an alternative C-clip 156' having inner and outer arms 158' and 160', respectively. The inside radius of the inner arm 158' is the same as that of the prior art C-clip 56, while the outside radius of the inner arm 158' (corresponding to radius R1 in FIG. 2) is substantially less than that of the prior art C-clip 56, resulting in a gap "G4" in the interface 164 at cold assembly. To produce these differing curves, the thickness of the inner arm 158' greatest at the center and tapers down near its distal ends. This configuration of the inner arm 158' accommodates the increased curvature mounting flange 154 described above without causing excessive stress at cold assembly. The same method of machining different portions of a component to different radii may be used with the shroud mounting flange 154.

Figure 7B:
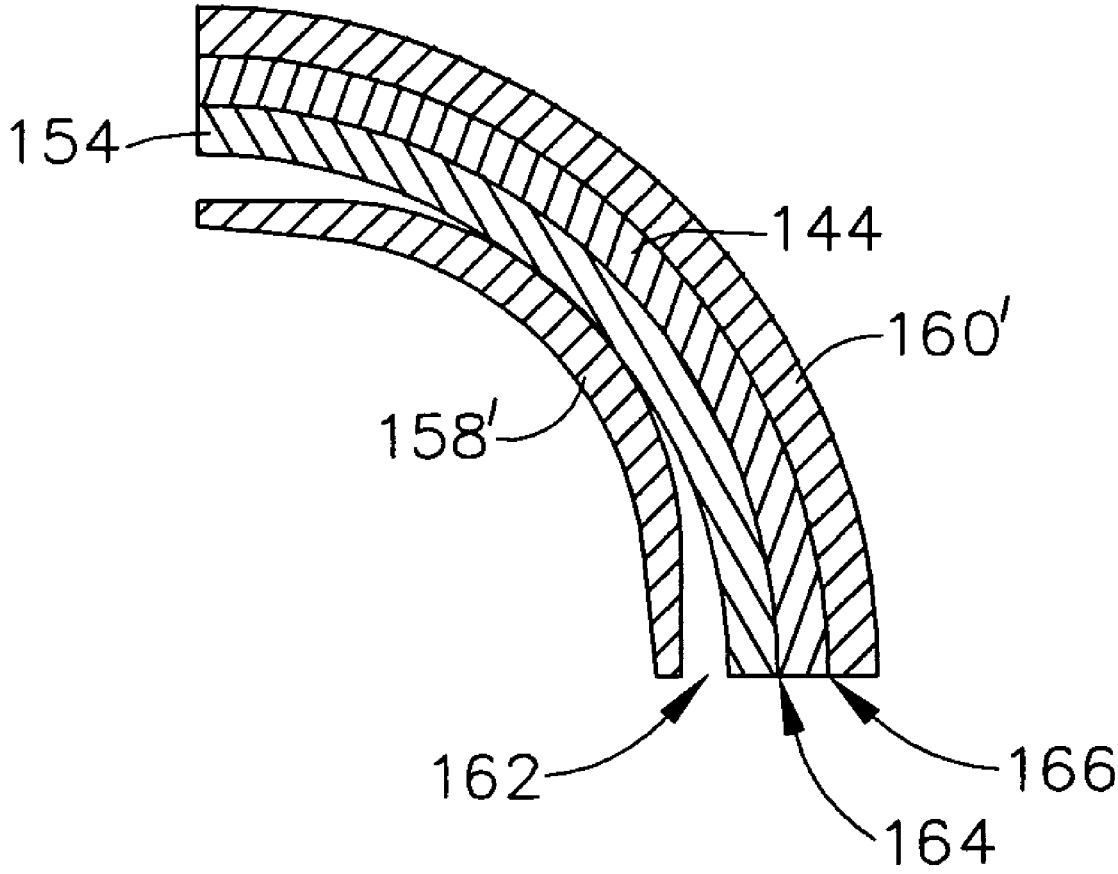
FIG. 7B is partial cross-sectional view taken along lines 6-6 of FIG. 5 at a hot operating condition, showing an alternative shroud assembly.

At operating temperatures, the aft mounting flange 154 will flatten out as it heats up, as described above. The provision of the gap "G4" at the cold assembly condition allows the aft mounting flange 154 to move in this direction without putting undue stress on the inner arm 158' of the C-clip 156', as shown in FIG. 7B.

The configurations described above can substantially reduce or eliminate bending stress on both the C-clip 156 or 156' and the shroud mounting flange 154. It also allows for hotter operating conditions and larger thermal gradients in the shroud segment 132, since temperature will have minimal to no effect on shroud rail or C-clip stresses. This configuration can eliminate the need for plastic deformation in the C-clip 156 and allow for alternative materials.

The foregoing has described a C-clip and shroud assembly for a gas turbine engine. While specific embodiments of the present invention have been described, it will be apparent to those skilled in the art that various modifications thereto can be made without departing from the spirit and scope of the invention. For example, while the present invention is described above in detail with respect to a second stage shroud assembly, a similar structure could be incorporated into other parts of the turbine. Accordingly, the foregoing description of the preferred embodiment of the invention and the best mode for practicing the invention are provided for the purpose of illustration only and not for the purpose of limitation, the invention being defined by the claims.

What is claimed is:

1. A shroud assembly for a gas turbine engine having a temperature at a hot operating condition substantially greater than at a cold assembly condition thereof, said shroud assembly comprising:

at least one arcuate shroud segment adapted to surround a row of rotating turbine blades, said shroud segment having an arcuate, axially extending mounting flange;

a shroud hanger having an arcuate, axially-extending hook disposed in contact with said mounting flange and defining a partial circumferential mating relationship between said hook and said flange; and an arcuate C-clip having inner and outer arms overlapping said mounting flange and said hook and defining, an inner interface between the inner arm and said flange and an outer interface between the outer arm and said hook;

wherein curvatures of said mounting flange and said inner arm of said C-clip are substantially greater than a curvature of said hook, and said C-clip is positioned such that the inner interface, outer interface, and at least a portion of the mating relationship are generally radially aligned.

2. The shroud assembly of claim 1 wherein said mounting flange and said hook define a radial gap therebetween positioned circumferentially away from the mating relationship.

3. The shroud assembly of claim 1 wherein said mounting flange and said C-clip are subject to thermal expansion at said hot operating condition, and said mounting flange and said hook define a matched interface therebetween at said hot operating condition.

4. The shroud assembly of claim 1 wherein said inner arm of said C-clip has an outside radius which is substantially less than an inside radius thereof.

5. The shroud assembly of claim 4 wherein a thickness of said inner arm of said C-clip is at a maximum at the center and at a minimum at distal ends thereof.

6. A shroud assembly for a gas turbine engine comprising:

a shroud hanger having an arcuate, axially-extending hook having a first cold curvature at an ambient temperature, and a first hot curvature at an operating temperature substantially greater than said ambient temperature;

at least one arcuate shroud segment adapted to surround a row of rotating turbine blades, said shroud segment having an arcuate, axially extending mounting flange having a second cold curvature at said ambient temperature, and a second hot curvature at said operating temperature, said mounting flange disposed in contact with said hook and defining a partial circumferential mating relationship between said hook and said flange;

an arcuate C-clip having inner and outer arms overlapping said mounting flange and said hook and defining an inner interface between the inner arm and said flange and an outer interface between the outer arm and said hook, said inner arm of said C-clip having a third cold curvature at said ambient temperature and a third hot curvature at said operating temperature, wherein said second and third cold curvatures are selected such that said first and second hot curvatures define a matched interface therebetween, and said C-clip is positioned such that the inner interface, outer interface, and at least a portion of the mating relationship are generally radially aligned.

7. The shroud assembly of claim 6 wherein said second and third cold curvatures are substantially greater than said first cold curvature.

8. The shroud assembly of claim 7 wherein said first and second hot curvatures define a matched interface therebetween, and said third hot curvature is substantially greater than said second hot curvature.

9. The shroud assembly of claim 6 wherein said third cold curvature of said inner arm of said C-clip is substantially greater than a cold curvature of the outer arm thereof.

10. The shroud assembly of claim 9 wherein said second and third hot curvatures define a gap therebetween at said hot operating condition and the gap is positioned circumferentially away from the mating relationship.

11. The shroud assembly of claim 6 wherein a preselected degree of radial interference is present between said inner arm and said mounting flange at both said cold assembly condition and said hot operating condition.

12. The shroud assembly of claim 6 wherein said first and second cold curvatures define a gap therebetween at said cold assembly condition and the gap is positioned circumferentially away from the mating relationship.

13. The shroud assembly of claim 6 wherein said inner arm of said C-clip has an outside radius which is substantially less than an inside radius thereof.

14. The shroud assembly of claim 13 wherein a thickness of said inner arm of said C-clip is at a maximum at the center and at a minimum at distal ends thereof.

* * * * *